United States Patent [19]

Franzen et al.

[11] 4,367,406

[45] Jan. 4, 1983

[54] CYLINDRICAL MIRROR ELECTROSTATIC ENERGY ANALYZER FREE OF THIRD-ORDER ANGULAR ABERRATIONS

[75] Inventors: Wolfgang Franzen, Harvard; James Taaffe, Arlington, both of Mass.

[73] Assignee: Trustees of Boston University, Boston, Mass.

[21] Appl. No.: 224,666

[22] Filed: Jan. 13, 1981

[51] Int. Cl.[3] ..... H01J 40/00

[52] U.S. Cl. ..... 250/305

[58] Field of Search ..... 250/305, 310, 281, 282

[56] References Cited

U.S. PATENT DOCUMENTS 3,699,331 10/1972 Palmberg ..... 250/305
3,735,128 5/1973 Palmberg ..... 250/305

FOREIGN PATENT DOCUMENTS 1316901 5/1973 United Kingdom ..... 250/305

OTHER PUBLICATIONS

"Principle of Modified Cylndrical Mirror Electron Spectrometer with Third-Order Focussing", Franzen et al., Abstract from Chicago Meeting of the American Physical Society, Jan. 21-24, 1980.

"Spectrum of Electrons Emitted in Atomic Collisions", Ogurtsov et al., *Soviet Physics*, vol. 14, No. 7, Jan. 1970, pp. 972-978.

"Design Parameters for Cylindrical Mirror Energy Analyzer", Risley, *Rev. of Sci. Ins.*, vol. 43, No. 1, Jan. 1972, pp. 95-103.

"Cylindrical Capacitor as an Anal. I. Nonrelativistic Part", Sar-el, *Rev. of Sci. Ins.*, vol. 38, No. 9, Sep. 1967, pp. 1210-1216.

"Focussing Properties of an Electrostatic Mirror With a Cylindrical Field", Zashkvara et al., *Sov. Physics-Tech. Physics*, vol. 11, No. 1, Jul. 1966, p. 96.

*Primary Examiner*—Bruce C. Anderson

*Attorney, Agent, or Firm*—Hamilton, Brook, Smith and Reynolds

[57] ABSTRACT

A cylindrical mirror electron spectrometer includes an additional electrode between the usual inner and outer cylinders. The additional electrode is maintained at a potential slightly more negative than the equipotential present without the electrode. The spectrometer can be dimensioned and the relative electric potentials on the three electrodes can be chosen so as to provide for third order focusing of electrons diverging from an axial source.

9 Claims, 5 Drawing Figures

FIG

CYLINDRICAL MIRROR ELECTROSTATIC ENERGY ANALYZER FREE OF THIRD-ORDER ANGULAR ABERRATIONS

DESCRIPTION

1. Field of the Invention

This invention relates to analyzers for determining energies of charged particles by dispersion in an electric field and focussing them onto a detector. The invention has particular application to coaxial analyzers designed to achieve very high energy resolution.

2. Background

In many charged particle energy analyzers, charged particles enter an electric field region of axial symmetry. The electric field causes the particles to follow trajectories dependent on their energies. By limiting the range of angles with respect to the axis of symmetry at which the particles enter the electric field region and by setting a detector at a predetermined focal distance from the particle source, the energy of the detected particles can be related to the electric field strength in such a way as to indicate the number of particles within a particular energy range $\Delta E$ emitted from the source.

A widely used electrostatic charged particle energy analyzer is the coaxial cylinder analyzer. In this analyzer, an electric field is established between two cylindrical electrodes. The charged particles are emitted from a field-free region maintained within the inner cylinder. Those emtted particles whose trajectories pass through an annular slit in that cylinder enter the electric field region maintained between the inner and outer cylinders. The slit width and the slit position along the axis of the inner cylinder relative to the particle source determine the range of angles at which the particles enter the electric field region between the two cylinders. Under the influence of this electric field, the particles follow trajectories which bring them back through an exit slit in the inner cylinder located some distance along the axis of the cylinders. The number of particles focused onto an aperture placed in front of a charge-particle detector on the axis of the inner cylinder is indicative of the number of particles in a particular range of energies emitted by the source. That energy range is dependent on the geometry of the analyzer as well as on the potential difference maintained between the two cylindrical electrodes. By varying the potential, an energy spectrum can be scanned. Alternatively, as taught by Palmberg in U.S. Pat. No. 3,699,331, the particles emitted into the electric field can be retarded by varying amounts dependent on their energies, and the potential between the cylindrical electrodes can be held constant.

At any instant, the detector views particles whose energy falls within an energy range $\Delta E$. High resolution in the analyzer is obtained by minimizing $\Delta E/E$ where E is the mean particle energy being detected. The energy range $\Delta E$ can be reduced by narrowing the inlet slit, thereby reducing the range of emission angles $\Delta\theta$ at which the charged particles enter the electric field. But reducing the width of the slit also reduces the number of charged particles which reach the detector, resulting in a low transmission of particles through the analyzer.

High transmission and good resolution can be attained by the analyzer when the geometry of the analyzer is chosen in such a way that the distance from the source to the focal point of the trajectories near the detector does not depend strongly on the emission angle. With conventional analyzers this is obtained by dimensioning the analyzer to have a second-order focus of the charged particles along the analyzer axis.

An object of the present invention is to provide a charged particle analyzer having relatively high resolution and transmission. A more particular object of this invention is to provide such an analyzer in which it is possible to obtain third or high order of focus.

SUMMARY OF THE INVENTION

In accordance with the present invention an electrostatic charged particle energy analyzer includes means for providing two different cylindrically symmetric electric field regions through which the charged particles are caused to pass. By providing such field regions, an analyzer can be designed to have a third or higher order focus. The required electric field configuration may be achieved by the addition of a third cylindrical electrode positioned between the inner and outer cylinders.

For the three cylinder analyzer, the optimum mean angle at which the electrons enter the electric field region through the slit in the inner cylinder is 39.98°, the optimum ratio of the radii of the two innermost electrodes is 1.4754 and the optimum value of the ratio of the electric field maintained just inside the intermediate cylinder to that maintained just outside the same cylinder is 1.0889. The resultant focal distance along the center axis of the electrodes is $5.7764R_1$, where $R_1$ is the radius of the inner cylinder.

To derive these optimum values of the parameters, the focal length of the spectrometer, expressed as a function of particle energy and of emission angle, has been derived. This focal length expression is then differentiated with respect to the emission angle. For three values of the emission angle, the derivative is equal to zero. By varying the values of the parameters, a set of values of the parameters can be found for which the three zeros of the derivative coincide. For that set of values, therefore, the spectrometer will have a third-order focus.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF THE INVENTION

Figure 2:
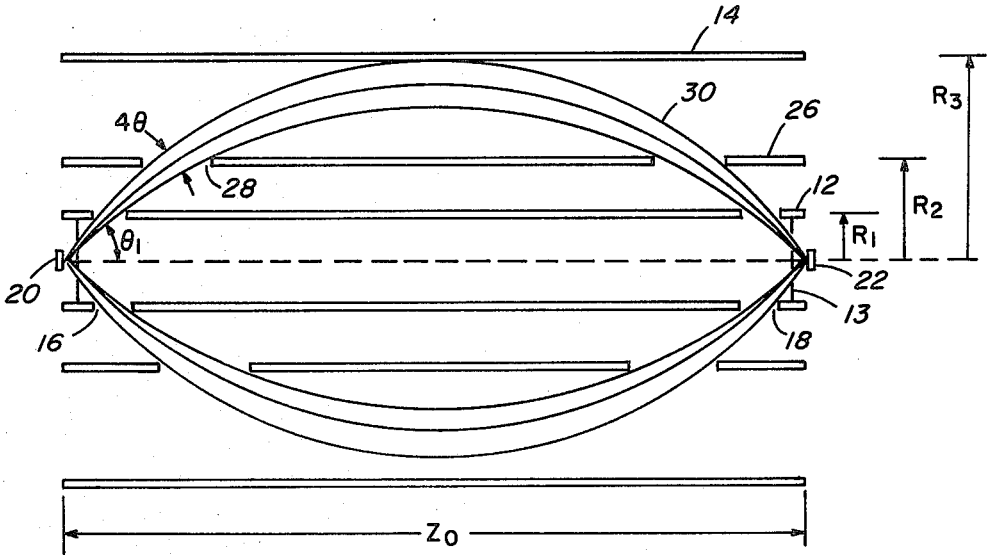
FIG. 2 is a longitudinal cross-sectional view of the invention in which a cylindrical analyzer includes an electrode between the inner and outer cylindrical electrodes.

A three-cylinder analyzer embodying this invention is illustrated in FIG. 2. As with conventional cylindrical analyzers, an inner cylindrical electrode 12 and an outer cylindrical electrode 14 are positioned coaxially. In accordance with this invention, an intermediate cylindrical electrode 26 is positioned between the inner and outer cylinders 12 and 14. The electrodes are held at different electric potentials to create electric fields between them. An annular entrance slit 16 and an annular exit slit 18 are provided in the inner cylinder 12. Similarly, 28 and 30 represent annular entrance and exit slits, respectively, of the intermediate cylinder 26. Some electrons or other charged particles emitted from a source 20 pass through the entrance slit 16 into the electric field between cylinders 12 and 26. The radius of cylinder 12 and the axial distance of the slit 16 from the source determines the range of emission angles $\theta_1 \pm \Delta\theta$ at which the electrons enter the field. The electrons next pass through the second annular slit 28 in the intermediate cylinder 26. A cylindrically symmetric electric field is maintained between the intermediate cylinder 26 and the outer cylinder 14. This field, when measured at the outer surface of the intermediate cylinder is slightly smaller, by a factor of 1.0889, than the field at the inner surface of the same cylinder. The electrons then pass successively through slits 30 and 12 to converge on or near point 22 on the axis of symmetry, provided their energy falls within a certain range of energies between $E+{}^{\Delta E}/2$ and $E-{}^{\Delta E}/2$, where E is the mean electron energy.

Depending on the strength of the electric field in the two different field regions, the electrons having an energy between $E-{}^{\Delta E}/2$ and $E+{}^{\Delta E}/2$ follow trajectories which bring them successively through slit 30 and then through exit slit 18, causing them to re-enter the field-free region inside the inner cylinder 12. If these trajectories are so directed that the electrons now pass through the energy-defining aperture 13, they arrive at the detector 22 and are detected. The level of the output signal from the detector 22 is indicative of the number of electrons having energies within the range from E to $E+{}^{\Delta E}/2$. Electrons of energies other than those within the range $E-{}^{\Delta E}/2$ to $E+{}^{\Delta E}/2$ follow trajectories which cause them to fail to pass through one of the slits 30 or 18 or the aperture 13. By varying the potentials between cylinders 12, 26 and 14, the range of energies observed by the detector 22 can be shifted from one end to another of the energy spectrum, so that the accumulated counts registered by the detector provide the energy spectrum of FIG. 1.

It is the positioning of electrode 26 and the ratio of the electric field intensities on the inside surface and the outside surface of this electrode that causes the trajectories of the particles to converge on the detector in such a way as to allow a focus of third order to be produced.

Electrons having an energy $E_o$ emitted at the mean angle $\theta_1$ intersect the axis of the analyzer at a distance $z_0$ from the source, as measured along that axis. But the slit 16 is of finite width so that the angle that the electron trajectories make with the axis of symmetry at the moment when they enter the electric field between cylinders 12 and 26 will have a spread of $\pm\Delta\theta$ around a mean value $\theta$. For any angle $\theta$ other than $\theta_1$, the ratio of the focal length z to $2R_1$ can be determined by a Taylor expansion of $z/2R_1$ considered as a function of $\theta$ around a chosen value $\theta_1$ as follows:

$$\frac{z(\theta)}{2R_1} = \frac{z_0(\theta_1)}{2R_1} + (\theta - \theta_1)\left[\frac{d(z_0/2R_1}{d\theta}\right]_{\theta_1} + \frac{(\theta-\theta_1)^2}{2!}\left[\frac{d^2(z_0/2R_1)}{d\theta^2}\right]_{\theta_1} + \frac{(\theta-\theta_1)^3}{3!}\left[\frac{d^3(z_0/2R_1)}{d\theta^3}\right]_{\theta_1} + \frac{(\theta-\theta_1)^4}{4!}\left[\frac{d^4(z_0/2R_1)}{d\theta^4}\right]_{\theta_1} + \ldots \quad (1)$$

where $\theta$ is in radians and $R_1$ is the radius of the inner cylinder 12. For small differences between $\theta$ and $\theta_1$ the low order terms of the Taylor expansion are of the greatest importance in their influence on the value of $z/2R_1$. The higher order terms are much less important as they represent much smaller quantities. It is thus advantageous to reduce the coefficients of the low-order terms, that is, the successive low-order derivatives, to zero at $\theta_1$ so that at small ranges of angles $\Delta\theta=(\theta-\theta_1)_{max}$ the change in the focal length from $z_0$ is dependent on the higher order terms only. These terms, as noted, have very little influence on the value of $z_0$ for small values of $\Delta\theta$. With conventional cylindrical analyzers the first and second derivatives of $z_0$ with respect to $\theta$ can be made zero. This provides a focus of second order, which means that the change in focal length with change in $\theta_1$ is a function primarily of the third-order term. By means of the present invention, the first three derivatives of the focal length with respect to emission angle can be reduced to zero so that the change in focal length with $\theta$ is primarily a function of the fourth-order term, or in other words, so that a focus of third order can be formed.

Figure 3:
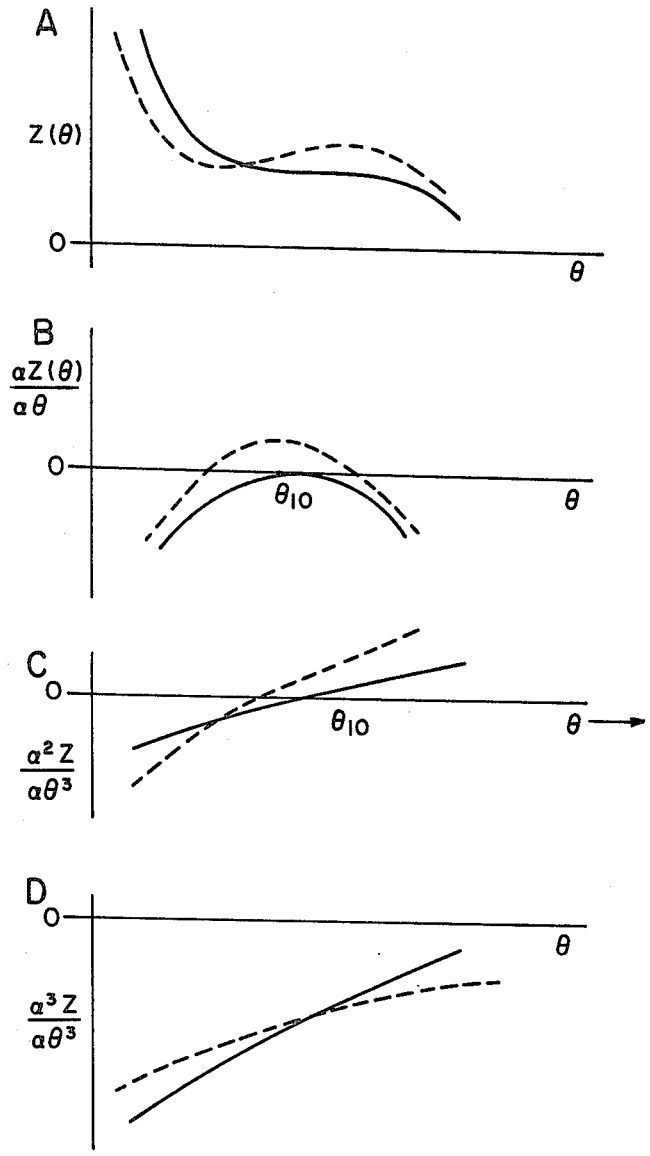
FIG. 3 graphically illustrates focal length as a function of the angle of emission and the first three derivatives thereof for a conventional two-cylinder analyzer.
Figure 4:
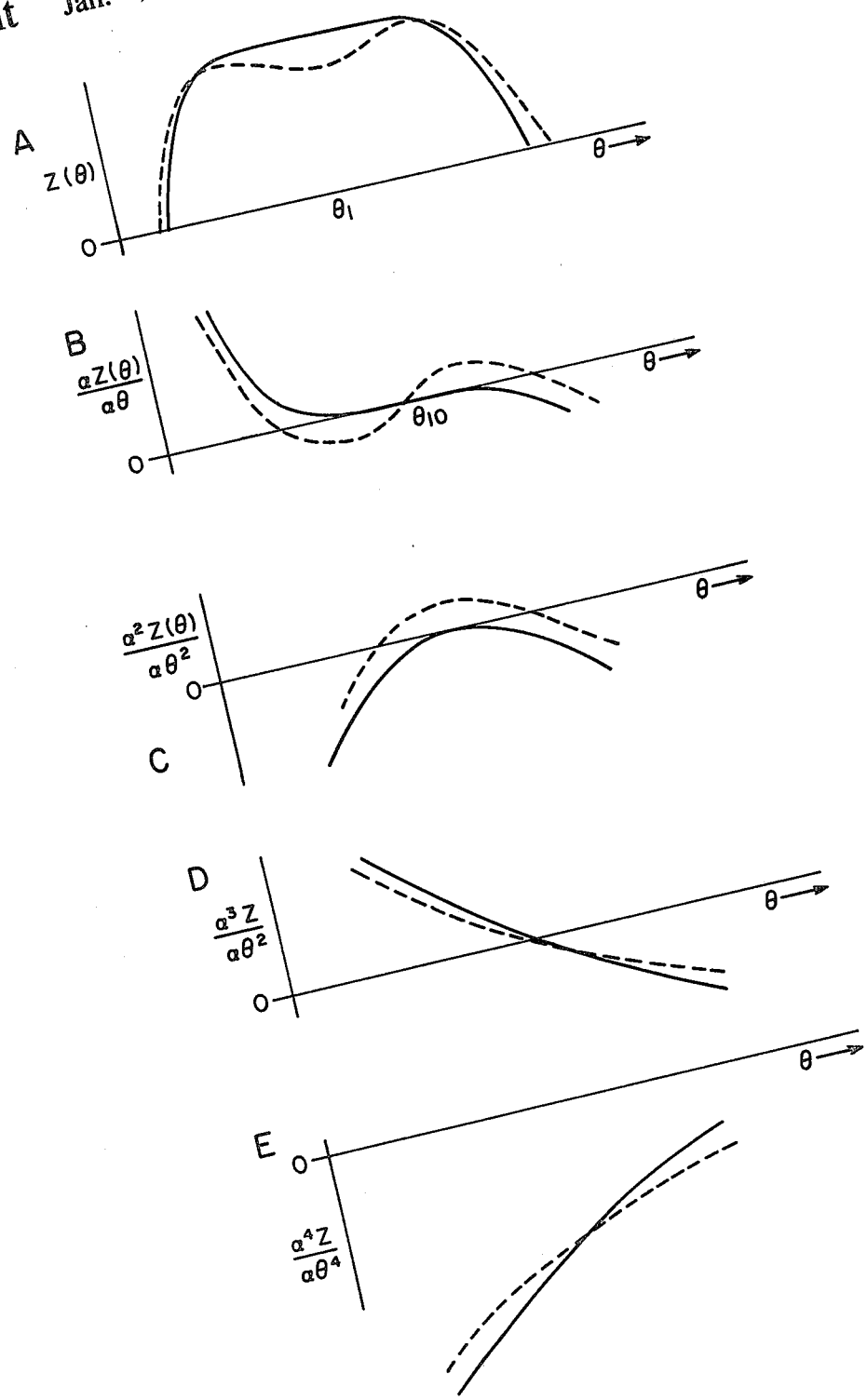
FIG. 4 graphically illustrates focal length as a function of the emission angle and the first four derivatives thereof for the analyzer of FIG. 2.

The distinctions between third and fourth order focusing can be seen graphically in FIGS. 3 and 4. $z_0$ as a function of $\theta$ for a two-cylinder analyzer of other than optimum geometry is shown by the dashed curve of FIG. 3A. The function includes a single minimum and a single maximum so that the first derivative expressed as a function of $\theta$ as shown by the dashed curve in FIG. 3B has two zeros. Similarly, the second derivative expressed as function of $\theta$ has one zero as shown by the dashed curve of FIG. 3C. By selecting the geometry of the two cylinder analyzer and the electric field between them such that the two zeros of the first derivative converge at a single angle $\theta_{10}$ the function $z(\theta)/2R_1$ and its derivatives assume the shapes plotted in solid lines in FIGS. 3A, 3B and 3C. It can be seen that there is a flat region in the $z(\theta)$ curve. In that flat region there is little change in the focal length with small changes in $\theta$ from the mean emission angle $\theta_{10}$. Thus, so long as the width of the inlet slit restricts the range of $\theta$ to a small angular range $\pm\Delta\theta$ the focal distance $z_0$ of electrons is nearly independent of $\theta$. If, however, the slit is made sufficiently wide, the focal length for electrons of a given energy which pass near the edge of the entrance slit will be significantly different from that of electrons which pass at the mean angle $\theta_1$. Thus electrons entering at different angles $\theta_1$ cannot be distinguished clearly from electrons that enter at the same angle, but that have different energies. As a result, the energy resolution of the spectrometer determined by the range of energies $\Delta E$ that can be clearly resolved by the instrument, is reduced.

By contrast, the function $z(\theta)$ resulting from the three-cylinder geometry is shown in FIG. 4A. Where the analyzer has other than optimum dimensions, the function has two maxima as shown by the dashed curve in FIG. 4A; that is, the first derivative has three zeros (FIG. 4B). The dimensions of the analyzer and the electric fields in the two field region can be selected in such a way that these three zeros in the first derivative occur at a single angle $\theta_{10}$, as shown by the solid curves of FIGS. 4A and 4B. The result of this convergence of the zeros of the first derivative is the vanishing of the second and third derivatives of $z(\theta)$ at the same angle $\theta_{10}$, thus giving rise to a focus of third order at $\theta_{10}$, as illustrated by the solid curves of FIGS. 4C and 4D. As a result, the function $z(\theta)$ has a very wide flat region around $\theta_{10}$.

The basic parameters in determining the function $z(\theta)$ are the radii $R_1$, $R_2$ and $R_3$ of the inner, middle and the outer cylinders, respectively, and the potential differences $U_{12}$ and $U_{23}$ between the respective cylinders. Those parameters are related to the following parameters $k_1$, $k_2$ and K for an electron of energy E and charge q:

$$b = \ln(R_2/R_1)$$

$$k_1 = \frac{E}{q\,|U_{12}|}\ln(R_2/R_1)$$

$$K = \frac{|U_{12}|}{|U_{23}|}\,\frac{\ln(R_3/R_2)}{\ln(R_2/R_1)}$$

Using those parameters, the focal length $z_0$ has been determined analytically to be given by the following expressions:

$$z_0 = 2R_1 \cot\theta_1[1+g(G)+h(G)] \tag{2}$$

where $G = k_1^{\frac{1}{2}} \sin\theta_1$ $g(G) = \pi^{\frac{1}{2}} G e^{G^2}[\mathrm{erf}G - erf(G^2-b)^{\frac{1}{2}}]$ $h(G) - \pi^{\frac{1}{2}} G K^{\frac{1}{2}} e^{-(K-1)b} e^{KG^2}\mathrm{erf}[K(G^2-b)]^{\frac{1}{2}}$ The first derivative of $z_0/2R1$ has been determined to have the following form:

$$\frac{d(z_0/2R_1)}{d\theta_1} = \tag{3}$$

$$-\alpha^{-1} + [2k_1(1-\alpha)-1](\pi k_1\alpha)^{\frac{1}{2}} e^{k_1\alpha}[erf(k_1\alpha)^{\frac{1}{2}} - erf(k_1\alpha - b)^{\frac{1}{2}}] + [2Kk_1(1-\alpha) - 1](\pi k_1 K\alpha)^{\frac{1}{2}} e^{b+K(k_1\alpha-b)} erf[K(k_1\alpha - b)]^{\frac{1}{2}} + 2k_1(1-\alpha)\left[1 + (K-1)e^b\left(\frac{k_1\alpha}{k_1\alpha - b}\right)^{\frac{1}{2}}\right].$$

where: $\alpha = \sin^2\theta_1$.

By means of a numerical computer search, it has been determined that the three zeros of the first derivative, equation 3, converge for the following values of the parameters b, $k_1$ and K, at an emission angle of $\theta_{10} = 39.98°$:

$$b = \ln(R_2/R_1) = .3889$$

-continued $$k_1 = \frac{bE}{q\,U_{21}} = 1.117$$

$$K = (|U_{12}|/b|U_{23}|)\ln(R_3/R_2) = 1.0889.$$

The ratio of the focal distance $z_0$ to the radius $R_1$ of the inner cylinder will then be:

$$z_0/R_1 = 5.7764.$$

Figure 1:
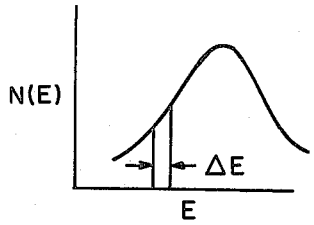
FIG. 1 is a representative plot of the number of charged particles detected by an analyzer as a function of their energy.

As already noted, the relative energy spread $\Delta E/E$ arising from angular aberration is preferably low to provide high energy resolution. With reference to FIG. 1, it is desirable to scan the spectrum through a small energy window $\Delta E$. The relative energy spread $\Delta E/E$ is dependent on three factors: the energy dispersion, the value of the dominant term of the Taylor expansion of $z(\theta)$ as a function of $(\theta - \theta_1)$ and whether that term is of odd or even order.

The energy dispersion D is the ratio of the change in focal distance $\Delta z_o$ to the relative energy spread $\Delta E/E_1$, for both the conventional two-cylinder analyzer and the three-cylinder analyzer here described. In other words, $D = E(dz_0/d\theta_{10})$. This quantity can be shown to be related to the optimum angle $\theta_{10}$ and the focal distance $z_0$ according to $$D = z_0/2\cos^2\theta_{10} \tag{5}$$

For the conventional analyzer $z_0$ equals $6.130R_1$ and $\cos^2\theta_{10}$ equal 0.54693 so that the dispersion D equals $5.604R_1$. For the modified spectrometer, $Z_0$ equals $5.776R_1$ and $\cos^2\theta_{10}$ equals 0.58710, so that the dispersion D equals $4.919R_1$. Thus, the dispersion for the conventional analyzer is slightly higher than for this modified analyzer. However, this loss in energy dispersion is more than offset by the advantages of third-order focusing.

For the conventional system the relative energy spread resulting from angular aberration is given by $$\frac{\Delta E}{E} = \frac{2}{D}\,\frac{(\Delta\theta)^3}{3!}\left(\frac{\delta^3 z_o}{\delta\theta_1^3}\right)_{\theta 10} = -5\cdot 542\,(\Delta\theta)^3 \tag{6}$$

where $\Delta\theta$ is the spread of emission angles above or below the mean angle $\theta_{10}$. The factor of two in the equation is a consequence of the odd order of the aberration. Because the change in angle to the third power is negative for negative changes and positive for positive changes from the mean emission angle, those angular aberrations have opposite effects on the change in energy so that the relative energy spread $\Delta E/E$ for a given $\Delta\theta$ is doubled.

On the other hand, the relative energy spread caused by angular aberration for the modified spectrometer is given by $$\frac{\Delta E}{E} = \frac{1}{D}\,\frac{(\Delta\theta)^4}{4!}\left(\frac{\delta^4 z_o}{\delta\theta_1^4}\right)_{\theta 10} = -19\cdot 31\,(\Delta\theta)^4. \tag{7}$$

Note that this is an aberration of even order. The change in angle to the fourth power is the same for both positive and negative angular changes. This can be seen graphically in FIG. 4A. However, the coefficient in equation 7 is over three times larger than that in equation 6 due to the high value of the fourth derivative of $z_0$ at $\theta_{10}$. However, for small ranges of emission angle $\Delta\theta$, $(\Delta\theta)^4$ is much smaller than $(\Delta\theta)^3$.

The transmission T of an electron spectrometer is the fraction of the electrons emitted into the forward hemisphere that are collected at the detector, that is, $$T = \frac{(2\Delta\theta)\,(2\pi\sin\theta_{10})}{2\pi} = 2\sin\theta_{10}(\Delta\theta). \tag{8}$$

It can be seen from equation 8 that the transmission is directly related to the range of emission angles, that is, to the width of the entrance slit. Since, for the range of angles of interest, the modified analyzer has greater resolution as determined by equation 7, for a desired resolution a wider slit can be used in the modified three-cylinder analyzer than in the conventional two-cylinder one, for a given relative energy spread $\Delta E/E$; and the transmission of the three-cylinder analyzer is thus large. The relationship between transmission and energy resolution limited by angular aberration, as deduced from equations 6, 7 and 8 is illustrated by the following table.

| $\frac{\Delta E}{E_o}$ | $\Delta\theta$ (degrees) conventional | $\Delta\theta$ (degrees) modified | T (percent of hemisphere) conventional | T (percent of hemisphere) modified |
|---|---|---|---|---|
| $10^{-4}$ | 1 · 50 | 2 · 73 | 3 · 52 | 6 · 12 |
| $3 \times 10^{-4}$ | 2 · 17 | 3 · 60 | 5 · 10 | 8 · 07 |
| $10^{-3}$ | 3 · 24 | 4 · 86 | 7 · 61 | 10 · 9 |
| $3 \times 10^{-3}$ | 4 · 67 | 6 · 40 | 11 · 0 | 14 · 4 |

It is evident that the modified spectrometer has the greatest advantage over the conventional one when very high energy resolution, that is a small value of $\Delta E/E_0$, is desired. For example, the transmission with a relative energy spread of $10^{-4}$ using the modified spectrometer is almost double that of the conventional spectrometer.

The analysis presented above must be modified slightly by taking into account higher-order mixed terms in the Taylor expansion of $z_0/2R_1$ around $\theta_{10}$ and $E_0$. This results in the following relationship:

$$\frac{z_o(\theta_1 \cdot E)}{2R_1} = 2 \cdot 8882 + 2 \cdot 459\left(\frac{\Delta E}{E_o}\right) + 4 \cdot 13\left(\frac{\Delta E}{E_o}\right)\Delta\theta - 47.5\,(\Delta\theta)^4. \tag{9}$$

Further, the above analysis was made for a point source on the axis and a correspondingly very small detector aperture. For a circular source disc of radius A and for a circular detector aperture of radius B placed in the image plane perpendicular to the axis, the maximum contribution on $\Delta E/E_0$ of those dimensions is:

$$\left(\frac{\Delta E}{E_o}\right)_{max} = 0.242\left(\frac{A+B}{R_1}\right) \tag{10}$$

For a complete analysis another factor to be considered is the angular motion of the electrons about the axis. That motion reduces the part of the initial kinetic energy of the electrons available for analysis by the spectrometer. For the conventional spectrometer, it has been shown that the maximum relative change in observed energy of an electron caused by this effect is given by $\Delta E/E_0 = -(A/R_1)^2$. This relationship also applies to the modified spectrometer described herein.

Figure 5:
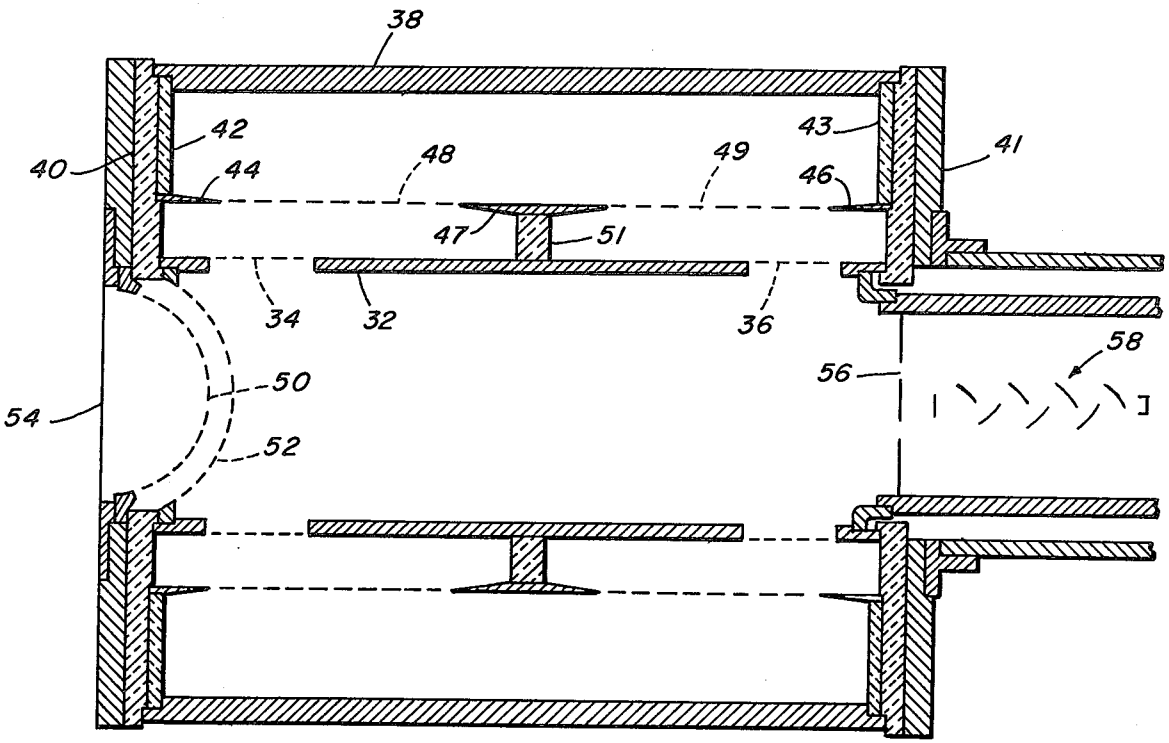
FIG. 5 is a cross-sectional view of another embodiment of this invention including a retarding grid at the source and a grid as the intermediate cylinder.

An alternative spectrometer embodying this invention is shown in FIG. 5. As before, an inner cylindrical electrode 32 is provided. The respective circular inlet and outlet slits in that cylinder are in this case covered by grids 34 and 36. Those grids do not unduly inhibit the emission of electrons past the cylinder 32. The grids 34 and 36 are held at the same potential as cylinder 32.

An outer cylindrical electrode 38 is spaced from the inner electrode 32 by two sets of ceramic discs 40, 41 and 42, 43. An intermediate cylinder comprising end rings 44 and 46, a center ring 47 and cylindrical grids 48 and 49 is positioned between the cylinders 32 and 38 by the ceramic spacers, including spacer 51.

As taught by Palmberg in U.S. Pat. No. 3,699,331, two spherical retarding grids 50 and 52 are positioned with their center at the particle source 54. As in the first embodiment, particles within a predetermined range of energies are focused through the circular aperture 56 onto an electron multiplier particle detector.

In the embodiments of both FIGS. 2 and 5, the extra design parameters which make possible the design of an analyzer having third-order focusing is the radial discontinuity in the electric field resulting from the added cylinder.

While the invention has been particularly shown and described with reference to a preferred embodiment thereof, it will be understood by those skilled in the art that various changes in form and details may be made therein without departing from the spirit and scope of the invention as defined by the appended claims. For example, the invention has been described primarily with respect to an electron spectrometer. A spectrometer might be designed for use in analyzing other charged particles as well. Also, a double pass spectrometer such as that shown in U.S. Pat. No. 3,699,331 to Palmberg may be modified in accordance with the principles of this invention. In that case, two electrode arrangements as shown in FIG. 5 would be arranged end-to-end with an aperture between the two. Charged particles would make one pass through one set of electrodes and pass through the center aperture and then make another pass through a second set of electrodes to a detector. If the analyzer is less than a full cylinder, the electron source and detector need not be on the axis.

I claim:

1. A charged particle energy analyzer comprised of three concentric cylindrical electrodes, with a field-free region inside the inner cylinder, an electric field between the inner and the middle cylinders, and a different electric field between the middle and outer cylinder, as well as a source of charged particles on the axis of symmetry of the three cylinders, and a detector at a distance from the source on the same axis, wherein the analyzer is dimensioned such that the charged particles pass through the inner and the middle cylinders and the first, second and third order terms of the Taylor expansion of the focal length $z_0$ of the analyzer, as a function of the angle of emission, are approximately zero.

2. A charged particle energy analyzer as claimed in claim 1 wherein the mean angle of emission of charged particles into the annulus between the first and second cylindrical electrodes is about 40° and the ratio of the radii of the first and second cylindrical electrodes is about equal to 1.475.

3. A charged particle energy analyzer as claimed in claim 2 wherein the mean angle of emission is 39.98° and the ratio of the radii of the first and second electrodes is 1.4754.

4. A charged particle energy analyzer as claimed in claim 3 wherein the focal distance $z_0$ along the center axis of the electrodes between the charged particles emitted into the electric field at the mean angle and the charged particles detected by the detector at a mean angle is about $5.776R_1$ where $B_1$ is the radius of the first electrode.

5. A charged particle energy analyzer as claimed in claim 4 wherein the distance $z_0$ is $5,7764R_1$.

6. A charged particle energy analyzer as claimed in claim 2 wherein the focal distance $z_0$ along the center axis of the electrodes between the charged particles emitted into the electric field at the mean angle and the charged particles detected by the detector at a mean angle is about $5.776R_1$ where $R_1$ is the radius of the first electrode.

7. A charged particle energy analyzer as claimed in claim 6 wherein the distance $z_0$ is $5.7764R_1$.

8. A charged particle energy analyzer as claimed in claim 1 wherein the analyzer is dimensioned such that the first, second and third order terms of the Taylor expansion of $z_0$ as a function of the angles of emission are approximately zero.

9. A charged particle energy analyzer comprising:

three concentric cylindrical electrodes, an electric field between the inner and the middle electrodes for pulling a charged particle toward the center of the electrode and a different electric field between the middle and the outer electrodes for pulling a charged particle toward the center of the electrodes;

a source of charged particles for emitting charged particles into the electric fields; and a detector for detecting particles which have followed predetermined trajectories through the electric fields;

wherein the analyzer is dimensioned such that the charged particles following said predetermined trajectories pass through the inner and middle electrodes.

* * * * *